US005689919A

United States Patent [19]

Yano

[11] Patent Number: 5,689,919

[45] Date of Patent: Nov. 25, 1997

[54] BASE ISOLATED BUILDING OF WIND RESISTING TYPE

[75] Inventor: Kenichi Yano, Tokyo, Japan

[73] Assignee: Kajima Corporation, Tokyo, Japan

[21] Appl. No.: 711,264

[22] Filed: Sep. 9, 1996

[30] Foreign Application Priority Data

Sep. 21, 1995 [JP] Japan ..... 7-243477

[51] Int. Cl.[6] ..... E04H 9/02

[52] U.S. Cl. ..... 52/167.6; 52/167.1; 52/167.4; 52/167.5; 248/550; 248/562; 248/636; 248/638

[58] Field of Search ..... 52/167.1, 167.4, 52/167.5, 167.6; 248/550, 562, 636, 638

[56] References Cited

U.S. PATENT DOCUMENTS

| | | | |
|---|---|---|---|
| 4,517,778 | 5/1985 | Niedlai | 52/167.5 |
| 4,662,133 | 5/1987 | Kondo | 52/167.6 |
| 4,883,250 | 11/1989 | Yano et al. | 52/167.1 X |
| 4,917,211 | 4/1990 | Yamada et al. | 52/167.6 X |
| 4,974,378 | 12/1990 | Shustov | 52/167.5 |
| 5,058,338 | 10/1991 | Ciampi | 52/167.5 X |
| 5,442,883 | 8/1995 | Hishimura et al. | 52/167.1 X |
| 5,544,452 | 8/1996 | Fujita et al. | 52/167.1 X |
| 5,558,191 | 9/1996 | Lai | 52/167.5 X |
| 5,576,971 | 11/1996 | Ishii et al. | 248/550 X |

*Primary Examiner*—Wynn E. Wood

*Attorney, Agent, or Firm*—Oblon, Spivak, McCelland, Maier & Neustadt, P.C.

[57] ABSTRACT

A house 2 is isolated from the foundation 1 by a rolling bearing 3. A vibration control device 6 with a releasable rigid connector 5 is added in parallel to the rolling bearing 3. Further, a release controller 8 of the rigid connector 5 is connected to the output end of an earthquake detector 7 on the house 2, so as to release the rigid connector 5 in response to output signal from the earthquake detector 7. Thus, the building 2 normally stands without vibration against wind by rigid connection to the foundation 1 through the rigid connector 5. On the other hand, when earthquake occurs, the rigid connector 5 is released by the release controller 8 by the output from the earthquake detector 7, so as to control the vibration of the building 2 by a combination of the rolling bearing 3 and the vibration control device 6.

4 Claims, 2 Drawing Sheets

BASE ISOLATED BUILDING OF WIND RESISTING TYPE

BACKGROUND OF THE INVENTION

1. Field of the Invention

This invention relates to a base isolated building of wind resisting type. In particular, the invention relates to a base isolated building of wind resisting type which does not vibrate when strong wind blows.

2. Description of the Prior Art

With the progress of computerization, a quite high degree of computer reliability is required, and there is a very strong demand for such environment in which even if earthquake occurs, regular computer operation is ensured while maintaining memories without any troubles. To meet such demand, various types of isolated floors, or floors isolated from foundation, have been proposed.

Referring to FIG. 2, Japanese Patent Application Laying-open Publication No. 087624/1993 disclosed an isolated floor 30 rollably supported on a building structure floor 1A by a rolling bearing device 3. The rolling bearing device 3 of this example comprises a receiving member 20 secured to the building structure floor 1A and having a bowl-shaped rolling surface, a large-diameter ball bearing 4 rollably engaging the bearing surface of the receiving member 20, and a support member 21 fixed to the base portion of the isolated floor 30 and rollably engaging the top portion of the ball bearing 4 through small-diameter ball bearings 24. Under normal conditions, the isolated floor 30 of such construction assumes stable position with the ball bearing 4 resting at the lowermost point 22 of the bearing surface of the receiving member 20. When earthquake occurs and the building structure floor 1A vibrates in response to the ground oscillation, the receiving member 20 vibrates together with the building structure floor 1A, but the large-diameter ball bearing 4 rotates or rolls on the bowl-shaped bearing surface of the receiving member 20 and noticeably suppresses the earthquake force being transmitted into the isolated floor 30. Thus, floor isolation necessary for ensuring stable computer operation is produced. When the earthquake vibration ceases, the large-diameter ball bearing 4 returns by itself due to the gravity toward the normal position at the lowermost point 22 of the bearing surface of the receiving member 20. The combination of a coil spring 31 and a damper 32 suppresses vibration in the vertical direction.

If one applies the structure of the above rolling bearing, such as the ball bearings, to a building, it has a short-coming in that when strong wind blows the building tends to sway back and forth by the wind pressure. In case of extremely strong wind, such as that of typhoon, persons in the building may get into sea-sick-like condition due to swaying of the building.

SUMMARY OF THE INVENTION

Therefore, an object of the invention is to provide such a base isolated building which stands still against wind pressure but becomes swayable upon occurrence of earthquake so as to reduce seismic force acting thereon. The inventor has noted if the conventional base isolated building is rigidly connected to the foundation in a releasable manner, in addition to the conventional connection to the foundation through the rolling bearing, so as to prevent swaying due to strong wind by the rigid connection, and if the above rigid connection is released upon occurrence of earthquake so as to become a vibration control device, then one can achieve the desired vibration control allowing no sway by strong wind yet allowing sway during earthquake while suppressing seismic force transmission by a combination of the rolling bearing and the vibration control device. The invention is based on such noting of the inventor.

More specifically, a conventional base isolated building has a base portion thereof, or a lower end portion thereof, supported by a foundation through a rolling bearing. With the invention, a vibration control device with a releasable rigid connector disposed between the building and the foundation is added in parallel to the conventional rolling bearing. An earthquake detector is mounted on the building, and the output from the earthquake detector is connected to a release controller of the releasable rigid connector. The release controller is to release the releasable rigid connector in response to output signal from the earthquake detector. Whereby, under normal conditions, the building is securely fixed to the foundation against wind pressure by the rigid connector of the vibration control device. On the other hand, upon occurrence of earthquake, the rigid connector is released by the release controller in response to the output from the earthquake detector so as to control vibration of the building by a combination of the rolling bearing and the vibration control device.

BRIEF DESCRIPTION OF THE ACCOMPANYING DRAWINGS

For a better understanding of the invention, reference is made to the accompanying drawings, in which FIG. 1 is a schematic diagram illustrating the formation of a base isolated building according to the invention; and FIG. 2 a schematic diagram of a conventional isolated floor supported by a rolling bearing.

Throughout different views of the drawings, like parts are designated by like numerals.

DESCRIPTION OF THE PREFERRED EMBODIMENT

Figure 1:
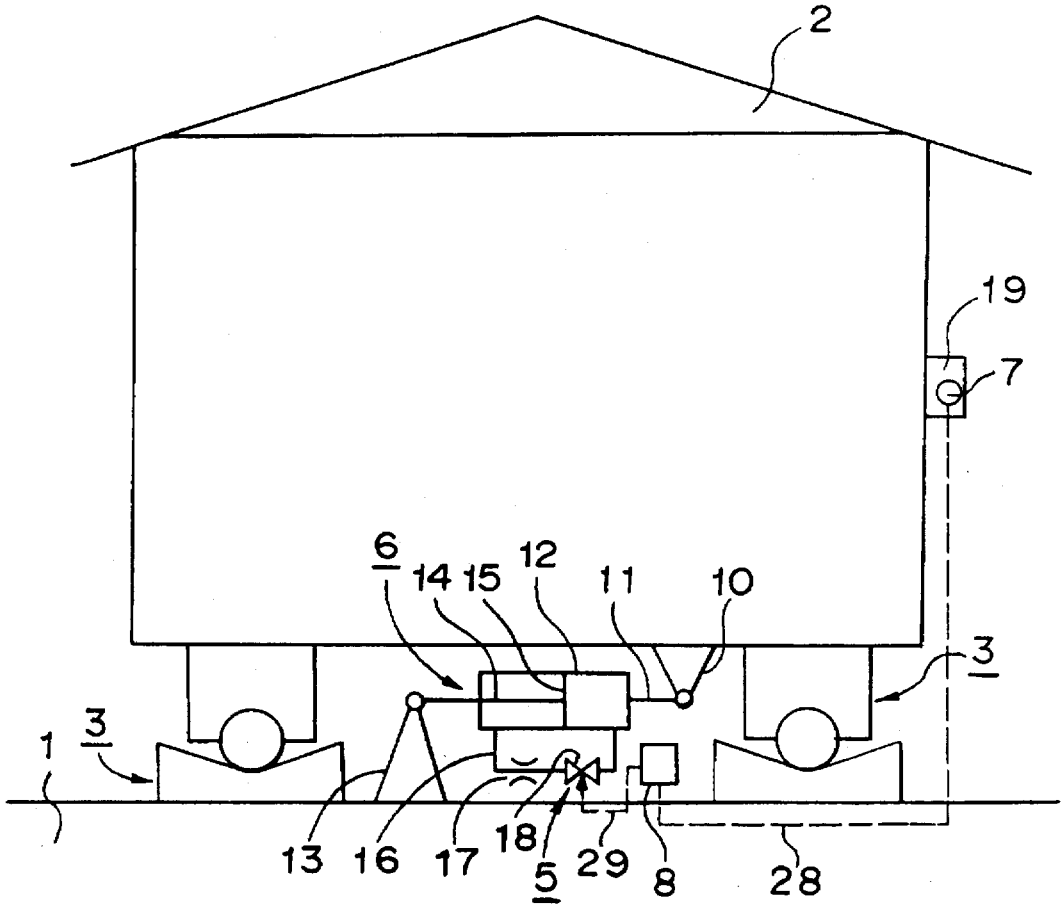

Referring to FIG. 1, a building 2 according to the invention has a base portion thereof supported by a foundation 1 through a conventional rolling bearing 3, and comprises a vibration control device 6 with a releasable rigid connector 5 disposed between the building 2 and the foundation 1. An earthquake detector 7 is mounted on the building 2, and a release controller 8 provided on the releasable rigid connector 5 is connected to output of the earthquake detector 7. The release controller 8 is adapted to release the rigid connector 5 in response to output signal from the earthquake detector 7. Whereby, the building 2 is normally fixed securely to the foundation 1 by the rigid connector 5 so that the building 2 may stand still against wind pressure, while upon occurrence of earthquake, the release controller 8 releases the rigid connector 5 in response to the output from the earthquake detector 7 so as to control vibration of the building 2 by a combination of the rolling bearing 3 and the vibration control device 6.

The earthquake detector 7 may be mounted on the foundation 1 or another suitable structural member secured to the ground, instead of the building 2.

Figure 2:
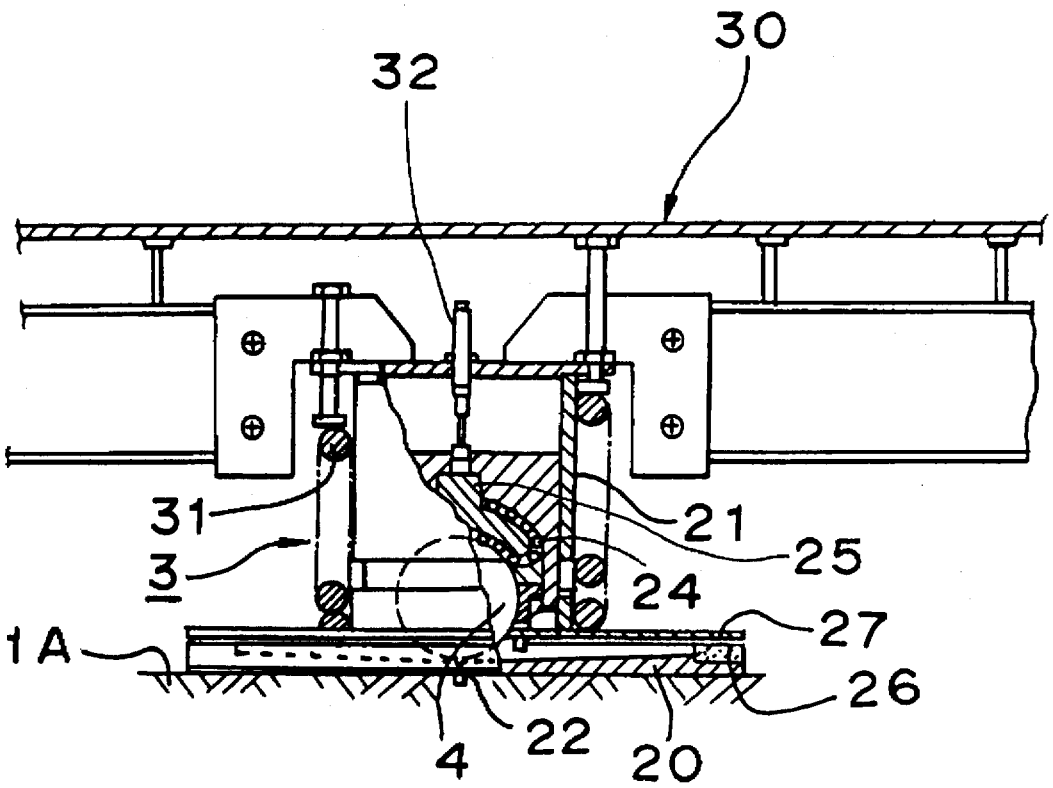

The rolling bearing 3 in the embodiment of FIG. 1 operates in the same manner as that of conventional isolated floor 30 which has been described hereinbefore by referring to FIG. 2. The vibration control device 6 of the embodiment includes a hydraulic cylinder 12 having one end connected to the base portion of the building 2 through a building-side connecting member 10 and a connecting rod 11. The opposite end of the hydraulic cylinder 12 is connected to the foundation 1 through a foundation-side connecting member 13, a piston rod 14, and a piston 15 movably disposed in the hydraulic cylinder 12. The vibration control device 6 also includes a hydraulic tube 16 connecting two chambers in the hydraulic cylinder 12 on opposite sides of the piston 15, a contracted portion 17 formed within the tube 16, and an electromagnetic valve 18 mounted in the tube 16.

In the vibration control device 6 of FIG. 1, the electromagnetic valve 18 acts as a releasable rigid connector 5, while a control circuit of the electromagnetic valve 18 acts as a release controller 8 of it. The vibration control device 6 of the invention is, however, not restricted to those using a hydraulic cylinder 12, but can be of any type as long as the function of vibration control is satisfied. Similarly, the releasable rigid connector 5 to be used in the invention is not restricted to those having the electromagnetic valve 18 but can be of any type provided that it is mountable on the vibration control device 6 and capable of providing the releasable rigid connection.

Under normal conditions, the electromagnetic valve 18 is energized or closed, so as to actuate the rigid connector 5 for providing the above-mentioned rigid connection. In particular, the connection between two chambers in the hydraulic cylinder 12 on opposite sides of the piston 15 is blocked, and the piston 15 is held stationary and the building 2 is rigidly connected to the foundation 1. Hence, even when strong wind blows, the building 2 is fixed to the foundation 1 and stands still against high wind pressure without any swaying.

Upon occurrence of earthquake, the earthquake detector 7 senses it and renders an output signal, and the release controller 8 deenergizes or opens the electromagnetic valve 18 in response to the output signal from the earthquake detector 7, so as to release the rigid connection of the rigid connector 5. More specifically, the two chambers in the hydraulic cylinder 12 are communicated through the hydraulic tube 16. Hence, the piston 15 becomes movable, but its movement is subjected the flow resistance of the contracted portion 17 in the hydraulic tube 16, so that resistance to the relative movement between the piston 15 and the hydraulic cylinder 12 is caused and vibration control is effected on the building 2 which is connected to the hydraulic cylinder 12. At the same time, with the rigid connector 5 thus released, the rolling bearing 3 allows the building 2 to roll relative to the foundation 1, and hence, during the earthquake, the building 2 sways while suppressing the seismic force thereto from the foundation 1, or the ground, by the combined action of the rolling bearing 3 and the vibration control device 6. Thus, vibration control is provided to the building 2 during the earthquake.

It is possible to make the above vibration control such that computer operation of a certain range is ensured during earthquake of expected magnitude, by suitable design of the rolling bearing 3 and the vibration control device 6. In the case that the large-diameter ball bearing 4 remains at a position away from the lowermost point 22 of the bearing surface of the receiving member 20 after the cease of the earthquake vibration, the large-diameter ball bearing 4 returns by itself due to gravity toward the lowermost point 22 of the bearing surface of the receiving member 20, so as to bear the building 2 at a stable position.

Thus, the above-mentioned object of the invention for providing a base isolated building which stands still against wind pressure but becomes swayable upon occurrence of earthquake so as to reduce seismic force acting thereon is fulfilled.

The rolling bearing 3 of FIG. 2 includes a receiving member 20 fixed to the foundation 1 and having a bowl-shaped bearing surface, and a support member 21 fixed to the base portion of the building 2 and rollably engaging the receiving member 20. Structure for the rollable engagement is provided by a large-diameter ball bearing 4 rollably engaging the bowl-shaped bearing surface of the receiving member 20, and a number of small-diameter ball bearings 24 rollably engaging the top surface of the large-diameter ball bearing 4. The support member 21 has a ball seat 25 which ensures smooth rolling in the bearing 3 through the combination of the large-diameter ball bearing 4 and the small-diameter ball bearings 24, by aligning the small-diameter ball bearings 24 in the form of a single layer. To prevent contamination by rain water and dust particles, the peripheral top surface 26 of the receiving member 20 is kept in direct contact with the bottom surface 27 of the support member 21 without any gap therebetween.

The earthquake detector 7 in the embodiment of FIG. 1 is fixed to a gas meter 19 mounted on the building 2. With this arrangement, the output signal from the earthquake detector 7 is used both for blocking gas supply piping and for releasing the rigid connector 5. In the figure, lead wire 28 connects the output signal from the earthquake detector 7 to the release controller 8, and lead wire 29 connects the output from the release controller 8 to the rigid connector 5.

As described in detail in the foregoing, the base isolated building of wind resisting type according to the invention bears the building by a combination of a rolling bearing and a vibration control device with a releasable rigid connector, so as to release the rigid connector in response to output from an earthquake detector. Hence, the following outstanding effects can be achieved.

(1) A building which does not sway at strong wind but sways only upon occurrence of earthquake for effective vibration control is provided.

(2) The building is borne by a rolling bearing 3, and the mode and range of the vibration control during earthquake can be determined substantially by the design of the vibration control device alone.

What is claimed is:

1. A base isolated building of wind resisting type having a base portion thereof supported by a foundation through a rolling bearing, the building comprising a vibration control device with a releasable rigid connector disposed between the building and the foundation, an earthquake detector mounted on the building, and a release controller connected to output from said earthquake detector and said rigid connector, the release controller being adapted to release said releasable rigid connector in response to output signal from the earthquake detector, whereby normally the building being securely fixed to the foundation against wind pressure by the rigid connector of the vibration control device, while upon occurrence of earthquake, the rigid connector is released by the release controller in response to the output from the earthquake detector so as to control vibration of the building by a combination of said rolling bearing and said vibration control device.

2. A base isolated building as set forth in claim 1, wherein said vibration control device includes a hydraulic cylinder having one end connected to either one of said foundation and base portion of the building, a piston in said hydraulic cylinder, the piston being connected to the remaining one of said foundation and base portion of the building, a hydraulic tube communicating two chambers in said hydraulic cylinder at opposite sides of said piston, a contracted portion formed in said hydraulic tube, and an electromagnetic valve disposed in said hydraulic tube, said hydraulic cylinder acting as said releasable rigid connector and said electromagnetic valve acting as said release controller of the rigid connector.

3. A base isolated building as set forth in claim 1, wherein said earthquake detector is fixed to a gas meter mounted on said building, whereby output signal from the earthquake detector is used both for blocking gas supply piping and for releasing said rigid connector.

4. A base isolated building as set forth in claim 2, wherein said earthquake detector is fixed to a gas meter mounted on said building, whereby output signal from the earthquake detector is used both for blocking gas supply piping and for releasing said rigid connector.

* * * * *